United States Patent [19]

Sasaki

[11] 4,343,097

[45] Aug. 10, 1982

[54] SHOES

[75] Inventor: Kyozo Sasaki, Hyogo, Japan

[73] Assignee: Sasaki Co., Ltd., Osaka, Japan

[21] Appl. No.: 176,632

[22] Filed: Aug. 8, 1980

[30] Foreign Application Priority Data

Aug. 27, 1979 [JP] Japan ..... 54-118064[U]

[51] Int. Cl.[3] ..... A43B 7/06

[52] U.S. Cl. ..... 36/3 A

[58] Field of Search ..... 36/3 R, 3 A, 8.1

[56] References Cited

U.S. PATENT DOCUMENTS

| | | | |
|---|---|---|---|
| 1,528,374 | 3/1925 | Gumaev | 36/3 A |
| 2,082,309 | 6/1937 | Turiansky | 36/3 A |
| 2,591,454 | 4/1952 | Manning | 36/3 A |

*Primary Examiner*—Patrick D. Lawson

*Attorney, Agent, or Firm*—Wenderoth, Lind & Ponack

[57] ABSTRACT

Shoes having an upper formed with a plurality of dimples with an air hole therein are proposed. Hot dieing to form dimples hardens the leather at the dimples, increasing the durability of the shoes. Thus, the shoes are highly durable even though they are provided with air holes in the upper.

2 Claims, 2 Drawing Figures

SHOES

The present invention relates to improvement in shoes, and particularly to shoes having an upper formed with a plurality of dimples which are provided with air holes.

Shoes having an upper provided with air holes prevent the foot from being sweaty and keep it sanitary because of increased permeability. However, conventional shoes provided with air holes had a shortcoming that a tear tends to be formed from the edge of each air hole. Therefore, they had a relatively poor durability. This is particularly true for sporting shoes used for vigorous exercise.

An object of the present invention is to provide shoes which obviate the above-mentioned shortcoming and which fit well to the foot, are comfortable to wear, keep the foot less sweaty and sanitary, and have a greater durability.

Other objects and advantages of this invention will become apparent from the following description taken with reference to the accompanying drawings, in which.

Figure 1:
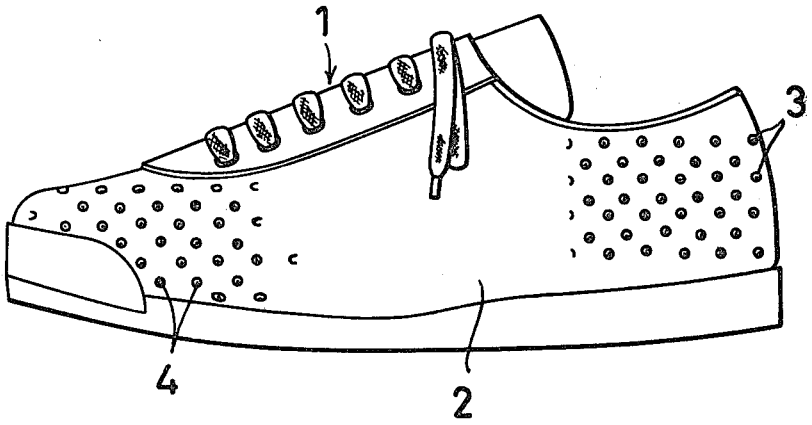
FIG. 1 is a side view of a shoe according to the present invention.
Figure 2:
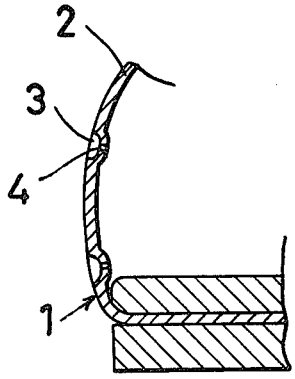
FIG. 2 is an enlarged sectional view of a portion thereof.

Referring to the drawings, the numeral 1 generally designates a shoe according to this invention. The shoe 1 has an upper 2 formed with a multiplicity of dimples or hollow depressions 3 in a suitable arrangement. Each dimple 3 is provided with an air hole 4 at its bottom.

Conveniently the dimples 3 may be formed by hot dieing before stitching the upper to the bottom. The air holes 4 may be formed either simultaneously with hot dieing or thereafter.

Although the dimples 3 are provided on substantially the whole part of the upper in the embodiment, they may be provided only at necessary portions. They may also be provided in the inner side of the upper, not in the outer side.

Processing with a hot die makes the texture of the leather between the surface of the hollow depression and the opposite surface of the material of the upper denser and hardens it at the dimples or in the neighborhood thereof. Therefore, there is little possibility of a tear starting from the edge of the air hole in each dimple.

Shoes having an upper formed with dimples fit better to the foot and are more comfortable to wear because of greater flexibility.

It will be understood from the foregoing that the shoes according to the present invention fit better to the foot, keep the foot dry and sanitary, reduce the fatigue of the foot, yet is sufficiently durable. Because of its high durability, it can be used as a sporting shoe.

What I claim:

1. A shoe having an upper, said upper having a plurality of hollow depressions in one of the surfaces thereof, each of said depressions having an air hole therein extending through the thickness of the material of the upper, the material of the upper between the surface of each of the hollow depressions and the opposite surface of the upper being denser and harder than the remainder of the material of the upper.

2. The shoe as claimed in claim 1 wherein said uppers are of leather and said depressions are formed by hot dieing.

* * * * *